US011232758B2

(12) United States Patent
Kang

(10) Patent No.: US 11,232,758 B2
(45) Date of Patent: Jan. 25, 2022

(54) PIXEL DRIVING METHOD, PIXEL DRIVING APPARATUS AND COMPUTER DEVICE

(71) Applicant: HKC CORPORATION LIMITED, Shenzhen (CN)

(72) Inventor: Chih Tsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/272,931

(22) PCT Filed: Dec. 19, 2018

(86) PCT No.: PCT/CN2018/121961
§ 371 (c)(1),
(2) Date: Mar. 3, 2021

(87) PCT Pub. No.: WO2020/103250
PCT Pub. Date: May 28, 2020

(65) Prior Publication Data

US 2021/0319761 A1 Oct. 14, 2021

(30) Foreign Application Priority Data

Nov. 20, 2018 (CN) ..... 201811384543.2

(51) Int. Cl.
*G09G 3/34* (2006.01)
*G09G 3/36* (2006.01)

(52) U.S. Cl.
CPC ..... *G09G 3/3413* (2013.01); *G09G 3/3648* (2013.01); *G09G 2320/0242* (2013.01)

(58) Field of Classification Search
CPC ..... G09G 3/3413; G09G 3/3607; G09G 2300/0452; G09G 2320/0242;
(Continued)

(56) References Cited

U.S. PATENT DOCUMENTS 7,893,904 B2 * 2/2011 Shih ..... G09G 5/06 345/88
10,553,165 B2 * 2/2020 Guan ..... G06T 7/90
2006/0221030 A1 10/2006 Shih et al.

FOREIGN PATENT DOCUMENTS

CN 1773595 A 5/2006
CN 104680.995 A 6/2015
(Continued)

OTHER PUBLICATIONS

Yanyan Wei, the ISA written comments, dated Aug. 2019, CN.
Yanyan Wei, the International Search Report, dated Aug. 2019, CN.

*Primary Examiner* — Koosha Sharifi-Tafreshi

(57) ABSTRACT

A pixel driving method is provided. The method includes: acquiring a pixel signal of each unit pixel in a pixel block; determining whether the pixel signal of the corresponding pixel block meets a first condition according to the pixel signal of each of the unit pixel and a signal determination interval; and if the graininess is determined during display, first-type gray-scale signals are loaded to a part of unit pixels of the pixel block and second-type gray-scale signals are loaded to the remaining unit pixels based on a preset rule, where the first-type gray-scale signals are not equal to the corresponding second-type gray-scale signals. The display quality is improved by controlling the unit pixel proportion loaded with the first-type gray-scale signals and the second-type gray-scale signals and reducing the difference among pixel signals.

20 Claims, 9 Drawing Sheets

(58) Field of Classification Search
CPC ..... G09G 3/2003; G09G 5/02; G09G 2320/0666; G09G 2340/06; G09G 3/2074; G09G 3/36; G09G 2320/0673; G09G 3/3648; G09G 2320/0276; G09G 2320/028
See application file for complete search history.

(56) References Cited

FOREIGN PATENT DOCUMENTS

| | | | |
|---|---|---|---|
| CN | 106328089 | A | 1/2017 |
| CN | 107154240 | A | 9/2017 |
| CN | 107492360 | A | 12/2017 |
| CN | 108133692 | A | 6/2018 |
| CN | 109285521 | A | 1/2019 |

* cited by examiner

| R | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Rave-1

Rave-i

| Rave | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Gave-1

Gave-j

| Gave | GH | GL |
|---|---|---|
| 0 | GH0 | GL0 |
| 1 | GH1 | GL1 |
| 2 | GH2 | GL2 |
| 3 | GH3 | GL3 |
| 4 | GH4 | GL4 |
| 5 | GH5 | GL5 |
| ⋮ | ⋮ | ⋮ |
| 50 | GH50 | GL50 |
| 51 | GH51 | GL51 |
| 52 | GH52 | GL52 |
| ⋮ | ⋮ | ⋮ |
| 253 | GH253 | GL253 |
| 254 | GH254 | GL254 |
| 255 | GH255 | GL255 |

| | R"ave | RM" | RL" |
|---|---|---|---|
| Rave-1 | 0 | RM"0 | RL"0 |
| | 1 | RM"1 | RL"1 |
| | 2 | RM"2 | RL"2 |
| | 3 | RM"3 | RL"3 |
| | 4 | RM"4 | RL"4 |
| | 5 | RM"5 | RL"5 |
| | ⋮ | ⋮ | ⋮ |
| | 50 | RM"50 | RL"50 |
| | 51 | RM"51 | RL"51 |
| | 52 | RM"52 | RL"52 |
| | ⋮ | ⋮ | ⋮ |
| Rave-i | 253 | RM"253 | RL"253 |
| | 254 | RM"254 | RL"254 |
| | 255 | RM"255 | RL"255 |

| | R'ave | RM' | RH' |
|---|---|---|---|
| Rave-1 | 0 | RM'0 | RH'0 |
| | 1 | RM'1 | RH'1 |
| | 2 | RM'2 | RH'2 |
| | 3 | RM'3 | RH'3 |
| | 4 | RM'4 | RH'4 |
| | 5 | RM'5 | RH'5 |
| | ⋮ | ⋮ | ⋮ |
| | 50 | RM'50 | RH'50 |
| | 51 | RM'51 | RH'51 |
| | 52 | RM'52 | RH'52 |
| | ⋮ | ⋮ | ⋮ |
| Rave-i | 253 | RM'253 | RH'253 |
| | 254 | RM'254 | RH'254 |
| | 255 | RM'255 | RH'255 |

PIXEL DRIVING METHOD, PIXEL DRIVING APPARATUS AND COMPUTER DEVICE

CROSS REFERENCE OF RELATED APPLICATIONS

The present application claims the priority to the Chinese Patent Application No. 201811384543.2, filed with National Intellectual Property Administration, PRC on Nov. 20, 2018 and entitled "PIXEL DRIVING METHOD, PIXEL DRIVING APPARATUS AND COMPUTER DEVICE", which is incorporated herein by reference in its entirety.

TECHNICAL FIELD

The present application relates to a pixel driving method, a pixel driving apparatus and a computer device.

BACKGROUND

The statements herein merely provide background information related to the present application and do not necessarily constitute the conventional art.

Currently, a Vertical Alignment (VA) liquid crystal technology or an In-Plane Switching (IPS) liquid crystal technology is mostly adopted for a large-sized display panel. The Vertical Alignment (VA) liquid crystal technology has higher production efficiency and lower cost compared with the In-Plane Switching (IPS) liquid crystal technology; however, it has more obvious defects compared with the In-Plane Switching (IPS) liquid crystal technology in optical property, especially when the large-sized display panel needs a larger viewing angle to be displayed in commercial application. As shown in FIG. 1, when the Vertical Alignment (VA) liquid crystal technology is adopted for display driving, the lightness at a large viewing angle is rapidly saturated with a signal (as shown in a curve 2), which causes the quality contrast and color shift at the large viewing angle to be worse than that at a positive viewing angle (as shown in a curve 1, lightness variation with a signal at the positive viewing angle).

Currently, the pixel driving method provided by the example technique may cause the image to have graininess due to the alternation of the bright and dark sub-pixels.

SUMMARY

The purpose of the present application is to provide a pixel driving method, a pixel driving apparatus and a computer device, so as to avoid the graininess in image display, thereby improving display quality.

In one aspect, the embodiments of the present application provide a pixel driving method, and the method includes:

acquiring a pixel signal of each unit pixel in a pixel block;

determining whether the pixel signal of the pixel block meets a first condition according to the pixel signal of each unit pixel and a signal determination interval, where the first condition is configured to represent the graininess of the pixel block during display; and if determining that the pixel signal of the pixel block meets the first condition, loading first-type gray-scale signals to a part of unit pixels in the pixel block and loading second-type gray-scale signals to the remaining unit pixels based on a preset rule, where the first-type gray-scale signals are not equal to the corresponding second-type gray-scale signals.

The pixel driving method provided by the embodiment of the present application includes determining whether the pixel signal of corresponding pixel block meets the first condition (whether the pixel block has graininess) by acquiring the pixel signal of each unit pixel in the pixel block and according to the pixel signal of each unit pixel and the signal determination interval, loading the new first-type gray-scale signals and the second-type gray-scale signals to each unit pixel in the pixel block if determining the pixel block has graininess during display, and the graininess of the pixel block during display is reduced by controlling the proportion of loading the first-type gray-scale signals and the second-type gray-scale signals to each unit pixel and reducing the difference among pixel signals.

In one or more embodiments, the signal determination interval includes a first-type interval and a second-type interval, and the step of determining whether the pixel signal of the pixel block meets the first condition according to the pixel signal of each unit pixel and a signal determination interval includes:

acquiring a second average pixel signal of each first grouping unit in the pixel block, where the first grouping unit includes two adjacent unit pixels, and no same unit pixel exists in each of the first grouping units;

acquiring a first proportion parameter of the second average pixel signal in each signal determination interval;

acquiring the first proportion parameter which is not less than a corresponding proportion standard value, where the corresponding proportion standard value is configured to measuring whether each of the first proportion parameters meets a standard proportion requirement of a corresponding signal determination interval;

if the signal determination interval corresponding to maximum first proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

In one or more embodiments, the signal determination interval includes a first-type interval and a second-type interval, and the step of determining whether the pixel signal of the pixel block meets the first condition according to the pixel signal of each unit pixel and a signal determination interval includes:

acquiring a second proportion parameter of the pixel signal of the unit pixel in each signal determination interval;

acquiring a second proportion parameter which is not less than the corresponding proportion standard value, where the corresponding proportion standard value is configured to measuring whether each first proportion parameter meets the standard proportion requirement of the corresponding signal determination interval;

if the signal determination interval corresponding to maximum second proportion parameter meeting standard proportion requirement is a first-type interval, determining that the pixel signal of the pixel block meets the first condition; and if the signal determination interval corresponding to the maximum second proportion parameter meeting standard proportion requirement is a second-type interval, determining that the pixel signal of the pixel block does not meet the first condition.

In one or more embodiments, the step of acquiring a first-type gray-scale signal and a second-type gray-scale signal includes:

if determining that the pixel signal of the pixel block meets the first condition, acquiring an average pixel signal of each second grouping unit in the pixel block, where the second grouping unit includes four adjacent unit pixels, and no same unit pixel exists in each of the second grouping units; and acquiring first-type gray-scale signal and second-type gray-scale signal corresponding to the average pixel signal of each second grouping unit by looking up a table.

In one or more embodiments, the step of acquiring a first-type gray-scale signal and a second-type gray-scale signal includes:

if determining that the pixel signal of the pixel block does not meet the first condition, acquiring an average pixel signal of each first grouping unit in the pixel block, where the first grouping unit includes two adjacent unit pixels, and no same unit pixel exists in each of the first grouping units; and acquiring the first-type gray-scale signal and the second-type gray-scale signal corresponding to the average pixel signal of each of the first grouping units by looking up a table.

In one or more embodiments, the unit pixel includes a red sub-pixel, and the step of loading first-type gray-scale signals to a part of unit pixels of the pixel block and loading second-type gray-scale signals to the remaining unit pixels of the pixel block based on a preset rule includes:

if determining that the pixel signal of the pixel block meets the first condition, loading first-type gray-scale signals to three red sub-pixels of each second grouping unit and loading second-type gray-scale signal to the remaining one red sub-pixel.

In one or more embodiments, the unit pixel includes a green sub-pixel, and the step of loading first-type gray-scale signals to a part of unit pixels of the pixel block and loading second-type gray-scale signals to the remaining unit pixels of the pixel block based on a preset rule includes:

if determining that the pixel signal of the pixel block meets the first condition, loading first-type gray-scale signals to three green sub-pixels of each second grouping unit and loading second-type gray-scale signal to the remaining one green sub-pixel.

In one or more embodiments, the unit pixel includes a blue sub-pixel, and the step of loading first-type gray-scale signals to a part of unit pixels of the pixel block and loading second-type gray-scale signals to the remaining unit pixels of the pixel block based on a preset rule includes:

loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

In one or more embodiments, the unit pixel includes a red sub-pixel, a green sub-pixel and a blue sub-pixel, and the pixel driving method further includes the steps of:

If determining that the pixel signal of the pixel block does not meet the first condition, loading the first-type gray-scale signals and the second-type gray-scale signals respectively to two adjacent same-color sub-pixels of each first grouping unit in the pixel block.

In one or more embodiments, before the step of acquiring a pixel signal of each unit pixel in the pixel block, the method further includes:

loading a group of initial high and initial low gray-scale signals respectively to unit pixels in the first grouping unit of the pixel block, where the first grouping unit includes two adjacent unit pixels, and no same unit pixel exists in each of the first grouping units.

A pixel driving apparatus includes:

a pixel signal acquisition circuit configured to acquire a pixel signal of each unit pixel in a pixel block;

a graininess determination circuit configured to determine whether the pixel signal of the pixel block meets a first condition according to the pixel signal of each unit pixel and a signal determination interval, where the first condition is configured to represent the graininess of the pixel block during display; and a driving signal loading circuit configured to load first-type gray-scale signals to a part of unit pixels of the pixel block and load second-type gray-scale signals to the remaining unit pixels of the pixel block based on a preset rule when determining that the pixel signal of the pixel block meets the first condition, where the first-type gray-scale signals are not equal to the corresponding second-type gray-scale signals.

A computer device includes a memory having computer-readable instructions stored therein and one or more processors, where the computer-readable instructions, when executed by the one or more processors, cause the one or more processors to perform the steps of:

acquiring a pixel signal of each unit pixel in a pixel block;

determining whether the pixel signal of the pixel block meets a first condition according to the pixel signal of each unit pixel and a signal determination interval, where the first condition is configured to represent the graininess of the pixel block during display; and if determining that the pixel signal of the pixel block meets the first condition, loading first-type gray-scale signals to a part of unit pixels in the pixel block and loading second-type gray-scale signals to the remaining unit pixels based on a preset rule, where the first-type gray-scale signals are not equal to the corresponding second-type gray-scale signals.

In one or more embodiments, the signal determination interval includes a first-type interval and a second-type interval, and the step of determining whether the pixel signal of the pixel block meets the first condition according to the pixel signal of each unit pixel and a signal determination interval includes:

acquiring a second average pixel signal of each first grouping unit in the pixel block, where the first grouping unit includes two adjacent unit pixels, and no same unit pixel exists in each of the first grouping units;

acquiring a first proportion parameter of the second average pixel signal in each signal determination interval;

acquiring the first proportion parameter which is not less than a corresponding proportion standard value, where the corresponding proportion standard value is configured to measuring whether each of the first proportion parameters meets a standard proportion requirement of a corresponding signal determination interval;

if the signal determination interval corresponding to maximum first proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

In one or more embodiments, a processor, when executing the computer readable instructions, further performs the steps of:

acquiring a second proportion parameter of the pixel signal of the unit pixel in each signal determination interval;

acquiring a second proportion parameter which is not less than the corresponding proportion standard value, where the corresponding proportion standard value is configured to measuring whether each first proportion parameter meets the standard proportion requirement of the corresponding signal determination interval;

if the signal determination interval corresponding to maximum second proportion parameter meeting standard proportion requirement is a first-type interval, determining that the pixel signal of the pixel block meets the first condition; and if the signal determination interval corresponding to the maximum second proportion parameter meeting standard proportion requirement is a second-type interval, determining that the pixel signal of the pixel block does not meet the first condition.

In one or more embodiments, a processor, when executing the computer readable instructions, further performs the steps of:

if determining that the pixel signal of the pixel block meets the first condition, acquiring an average pixel signal of each second grouping unit in the pixel block, where the second grouping unit includes four adjacent unit pixels, and no same unit pixel exists in each of the second grouping units; and acquiring first-type gray-scale signal and second-type gray-scale signal corresponding to the average pixel signal of each second grouping unit by looking up a table.

In one or more embodiments, a processor, when executing the computer readable instructions, further performs the steps of:

if determining that the pixel signal of the pixel block does not meet the first condition, acquiring an average pixel signal of each first grouping unit in the pixel block, where the first grouping unit includes two adjacent unit pixels, and no same unit pixel exists in each of the first grouping units; and acquiring the first-type gray-scale signal and the second-type gray-scale signal corresponding to the average pixel signal of each of the first grouping units by looking up a table.

In one or more embodiments, a processor, when executing the computer readable instructions, further performs the steps of:

if determining that the pixel signal of the pixel block meets the first condition, loading first-type gray-scale signals to three red sub-pixels of each second grouping unit and loading second-type gray-scale signal to the remaining one red sub-pixel.

In one or more embodiments, a processor, when executing the computer readable instructions, further performs the steps of:

if determining that the pixel signal of the pixel block meets the first condition, loading first-type gray-scale signals to three green sub-pixels of each second grouping unit and loading second-type gray-scale signal to the remaining one green sub-pixel.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can acquire other drawings according to the drawings without any inventive labor.

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are only for explaining, but not for limiting the present application.

It should be noted that when an element is referred to as being "connected to" another element, it can be directly connected to the other element, or an intervening element may also be present. The terms "mounted", "one end", "the other end" and the like as used herein are for illustration purposes only.

Unless defined otherwise, all technical and scientific terms used herein have the same meaning as commonly understood by one of ordinary skill in the art to which the present application belongs. The term used in the specification of the present application herein is for the purpose of describing particular embodiment only and is not intended to be limiting of the present application. As used herein, the term "and/or" includes any and all combinations of one or more of the associated listed items.

Figure 1:
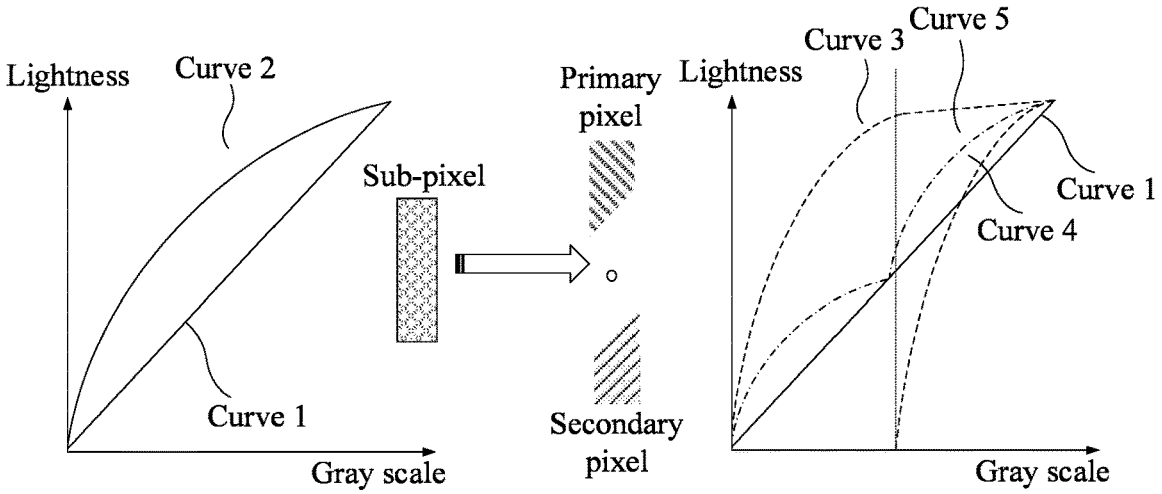
FIG. 1 shows the display lightness of pixels varying with gray-scale signals at a positive viewing angle and a large viewing angle when a VA liquid crystal technology is adopted for display driving.
Figure 2:
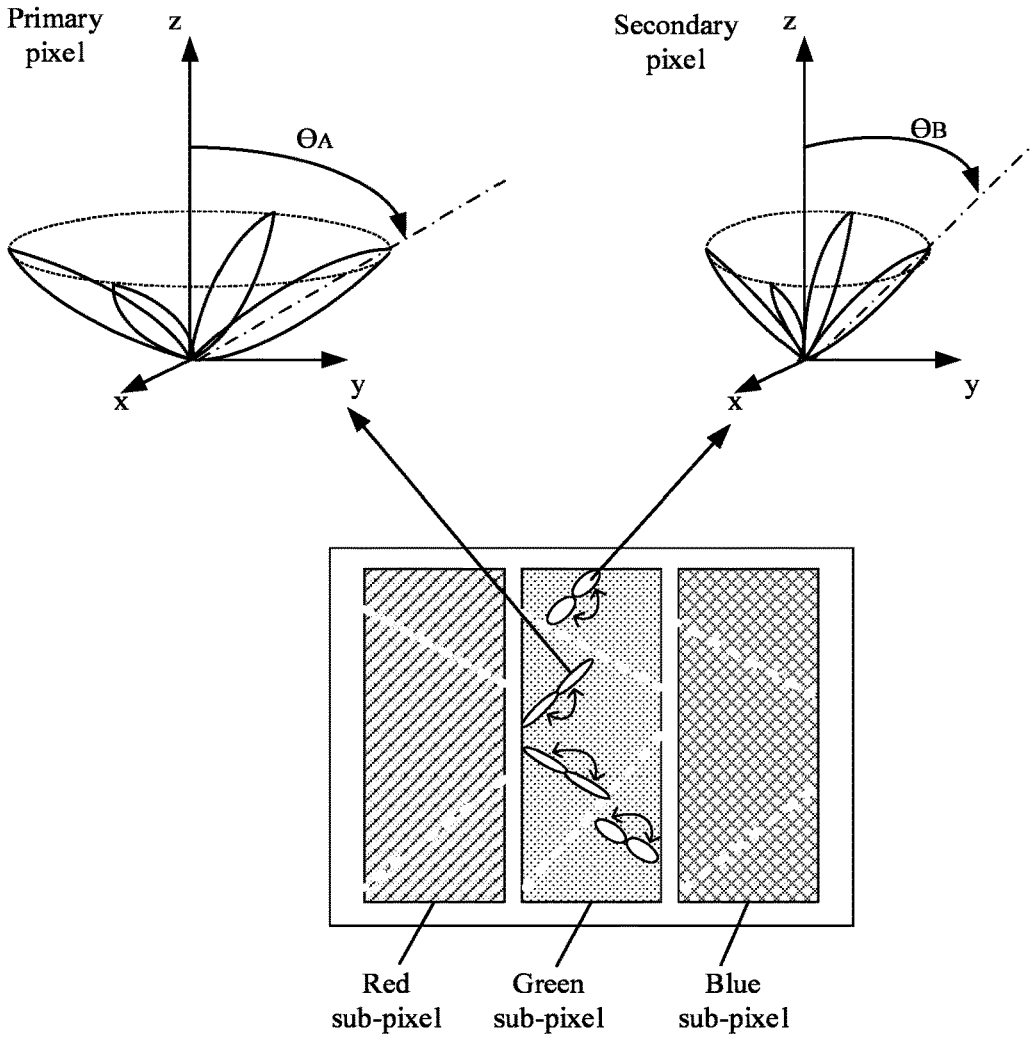
FIG. 2 shows the display lightness of primary pixels and secondary pixels varying with gray-scale signals at the positive viewing angle and the large viewing angle when the primary pixels and the secondary pixels are driven by respectively loading different gray-scale signals.

In an example technique, two adjacent red sub-pixels (green sub-pixels/blue sub-pixels) are divided into primary pixels and secondary pixels, and then different gray-scale voltages are applied to the primary pixels and the secondary pixels, as shown in FIG. 1. When the divided primary pixels and secondary pixels applied with different gray-scale voltages are driven (curve 3 is the variation of the primary pixels lightness with signals, and curve 4 is the variation of the secondary pixels lightness with signals), the curve (curve 5) in which side-view lightness of the display panel composed of the primary pixels and secondary pixels varies with signals is closer to curve (curve 1) in which positive-view lightness varies with signals, as shown in FIG. 2. Taking green sub-pixels as an example, the defect of the color shift of viewing angle can be solved by spatially designing the primary pixels and secondary pixels and applying different driving signals to them.

Figures 3, 4:
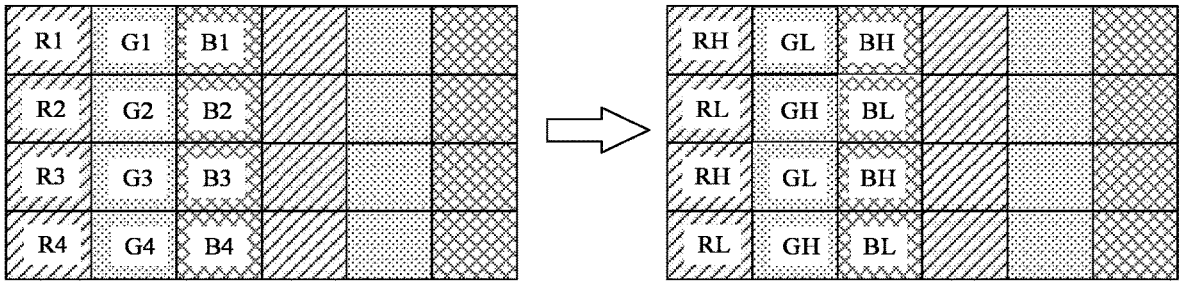
FIG. 3 is a schematic diagram of pixel voltage distribution of the primary pixels and the secondary pixels of a pixel driving method according to an embodiment.
FIG. 4 is a table showing a relationship between the high and low gray-scale signals respectively loaded to the primary pixels and the secondary pixels and the average pixel signal according to an embodiment.

Referring to FIG. 3, for the red sub-pixels, by sacrificing spatial resolution, a group of high and low gray-scale signals RH and RL can be configured to replace original signals R1 and R2 of the sub-pixels, and the combination of the high gray-scale signal and the low gray-scale signal can achieve the effect of improving the color shift of viewing angle. At the positive viewing angle, the average lightness of the group of high and low gray-scale signals RH and RL can maintain the same as that of the original two independent sub-pixel signals R1 and R2. Referring to FIG. 4, taking 8-bit display driver as an example, the gray-scale signal of each sub-pixel is 0, 1, . . . , or 255, the two original independent sub-pixel signals R1, R2 are also gray-scale signals in 0, 1, . . . , 255, the average signal Rave of two adjacent same-color sub-pixels R1, R2 is also a gray-scale signals that is 0, 1, . . . , or 255, and a group of high and low gray-scale signals RH and RL corresponding to the average signal Rave of two adjacent sub-pixels can be found by looking up a table. As shown in FIG. 3, two adjacent same-color sub-pixels are driven to display by high and low gray-scale signals, respectively. In summary of the implementation process of the present applicant, it is found that the above-mentioned manner of driving each sub-pixel by high and low gray-scale signal spatially can improve the color shift of viewing angle. However, due to the alternation of bright and dark sub-pixels, when the lightness difference of the bright and dark sub-pixels is large, the graininess during display is easily occurred, thus the display quality cannot be ensured.

Based on the above, it is desirable to provide a pixel driving method, a pixel driving apparatus, a computer device, and a computer-readable storage medium for solving a problem of the graininess in image display.

Figure 5:
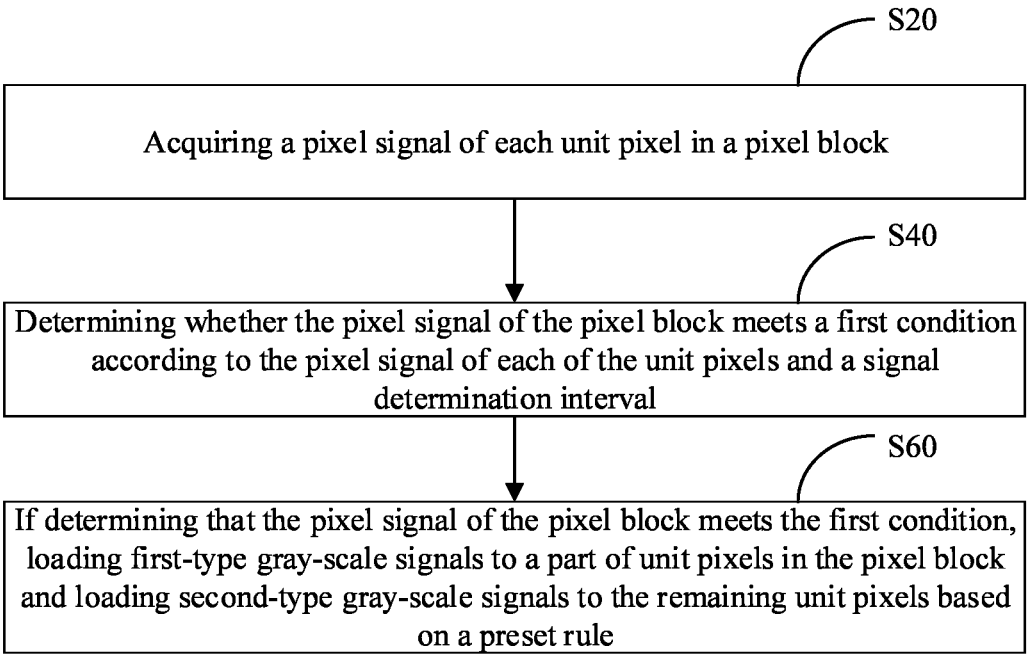
FIG. 5 is a flow schematic diagram of a pixel driving method according to an embodiment.

In one aspect, as shown in FIG. 5, the embodiments of the present application provide a pixel driving method, and the method includes:

S20: acquiring a pixel signal of each unit pixel in a pixel block;

S40: determining whether the pixel signal of the pixel block meets a first condition according to the pixel signal of each unit pixel and a signal determination interval, where the first condition is configured to represent the graininess of the pixel block during display; and S60: if determining that the pixel signal of the pixel block meets the first condition, loading first-type gray-scale signals to a part of unit pixels in the pixel block and loading second-type gray-scale signals to the remaining unit pixels based on a preset rule, where the first-type gray-scale signals are not equal to the corresponding second-type gray-scale signals.

Figures 6, 7:
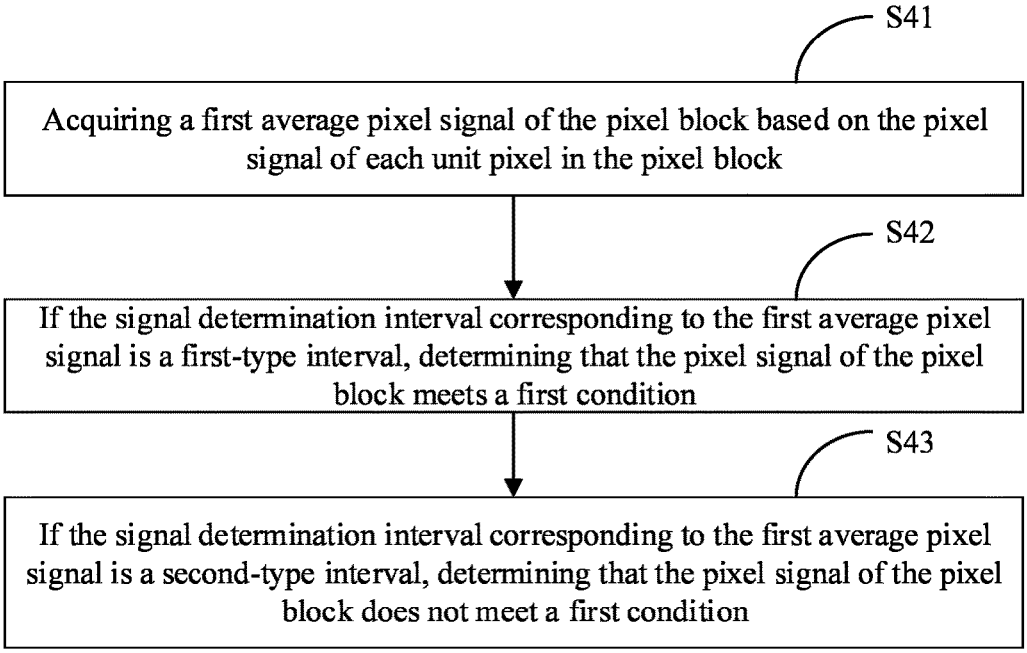
FIG. 6 is a table showing the relationship between a first-type gray-scale signal and a second-type gray-scale signal corresponding to each average pixel signal according to an embodiment.
FIG. 7 is a flow schematic diagram of the step of determining whether the pixel signal of the pixel block meets a first condition according to an embodiment.

The pixel block may be a block including a plurality of unit pixels, for example, one pixel block may be a block in units of n*m unit pixels. The unit pixel includes one or more sub-pixels, for example, the unit sub-pixel may include a red sub-pixel, a green sub-pixel and/or a blue sub-pixel. The unit pixel may further include a white sub-pixel and the like. The signal determination interval is a reference for determining whether a pixel block consisting of each unit pixel has graininess during display, and each signal determination interval corresponds to a plurality of average pixel signals. Taking the red sub-pixel and the green sub-pixel in each unit pixel as an example, as shown in FIG. 6, the average pixel signal Rave of the red sub-pixel is divided into a plurality of intervals: Rave-1, Rave-2, . . . and Rave-i. For some intervals, when the lightness difference of high and low gray-scale signals loaded to each unit pixel in the pixel block is large, and the proportion of sub-pixels loaded with the high and low gray-scale signals is the same, the graininess is obvious during overall display. Rave-1 may correspond to an interval where the average pixel signal Rave is 0 to 1. The preset rule is a rule preset by experiences such as experiments and configured to direct the adjustment of the difference value of the first-type gray-scale signal and the second-type gray-scale signal loaded to each unit pixel and the adjustment of the proportion of the sub-pixels loaded with the first-type gray-scale signal and the second-type gray-scale signal in the pixel block so as to weaken the graininess of the pixel block during display. The first-type gray-scale signal and the second-type gray-scale signal are set correspondingly, that is, each first-type gray-scale signal corresponds to a second-type gray-scale signal, and the value of the first-type gray-scale signal is not equal to that of the corresponding second-type gray-scale signal. Optionally, the average signal of each unit pixel corresponds to a group of first-type and second-type gray-scale signals.

Specifically, firstly, a pixel signal of each unit pixel in a pixel block is acquired, that is, the strength of an original independent sub-pixel gray-scale signal of each pixel block is acquired, then whether the pixel block has graininess when displayed as a whole is determined according to the pixel signal of each unit pixel and a signal determination interval, if so, that is, the pixel signal of the pixel block meets a first condition, first-type gray-scale signals are reloaded to a part of unit pixels in the pixel block and second-type gray-scale signals are loaded to the remaining unit pixels based on a preset rule, and the graininess of the pixel block during display is reduced by reducing the strength difference of the gray-scale signals loaded on the sub-pixels of the pixel block and adjusting the proportion of loaded high and low gray-scale signals.

Figure 8:
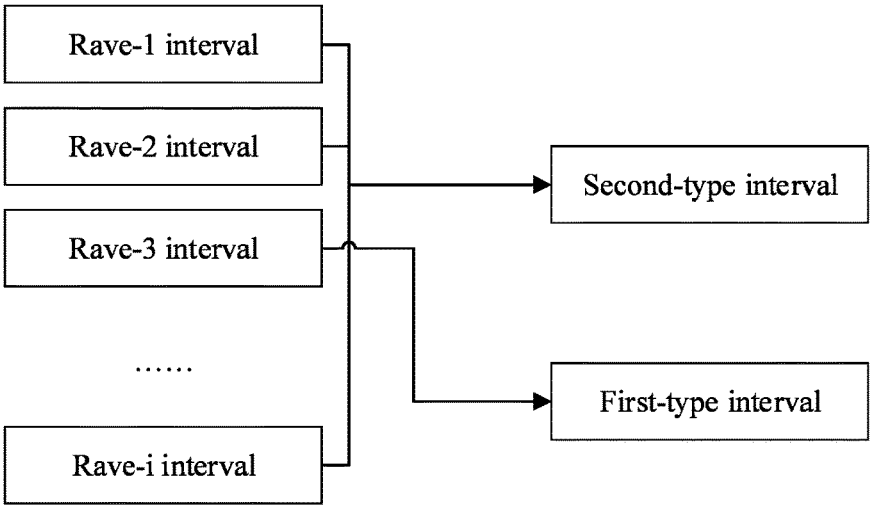
FIG. 8 is a schematic diagram illustrating a relationship between signal determination intervals and interval types according to an embodiment.

In one or more embodiments, as shown in FIGS. 7 and 8, the signal determination interval includes a first-type interval and a second-type interval, and the step of determining whether the pixel signal of the pixel block meets the first condition according to the pixel signal of each of the unit pixels and a signal determination interval includes:

S41: acquiring a first average pixel signal of the pixel block based on the pixel signal of each unit pixel in the pixel block;

S42: if the signal determination interval corresponding to the first average pixel signal is a first-type interval, determining that the pixel signal of the pixel block meets a first condition; and S43: if the signal determination interval corresponding to the first average pixel signal is a second-type interval, determining that the pixel signal of the pixel block does not meet a first condition.

The first-type interval is configured to represent an interval in which when the lightness difference of high and low gray-scale signals loaded to each unit pixel in the pixel block is large, and the proportion of sub-pixels loaded with the high and low gray-scale signals is substantially the same, the graininess is obvious during overall display. The second-type interval is configured to represent the interval in which the displayed lightness difference after the high and low signals loaded to each unit pixel in the pixel block is small, and the human eyes cannot perceive graininess during display.

Specifically, before adjusting the gray-scale signal loaded to the unit pixel, it is necessary to know whether each pixel block has graininess during display. In one or more embodiments, an average pixel signal of the whole pixel block may be acquired and recorded as a first average pixel signal according to the acquired pixel signal of each unit pixel, then a signal determination interval corresponding to the first average pixel signal is acquired, and then whether the signal determination interval is a first-type interval or a second-type interval is determined, as shown in FIG. 8, if the signal determination interval is the first-type interval, it is indicated that the differences in high and low gray-scale signals are large, and the proportion of unit pixels loaded with the high and low gray-scale signals is similar when the pixel block is displayed as a whole, and the probability of graininess when displayed as a whole is large. In order to ensure the display quality, first-type gray-scale signals are loaded to a part of unit pixels and second-type gray-scale signals are loaded to the remaining unit pixels based on a preset rule, the differences between the first-type gray-scale signals and the corresponding second-type gray-scale signals is small, and the graininess of the pixel block during display is reduced by adjusting the proportion of high and low gray-scale signals loaded to the pixel block and reducing the strength difference of the high and low gray-scale signals loaded on the sub-pixels.

Figure 9:
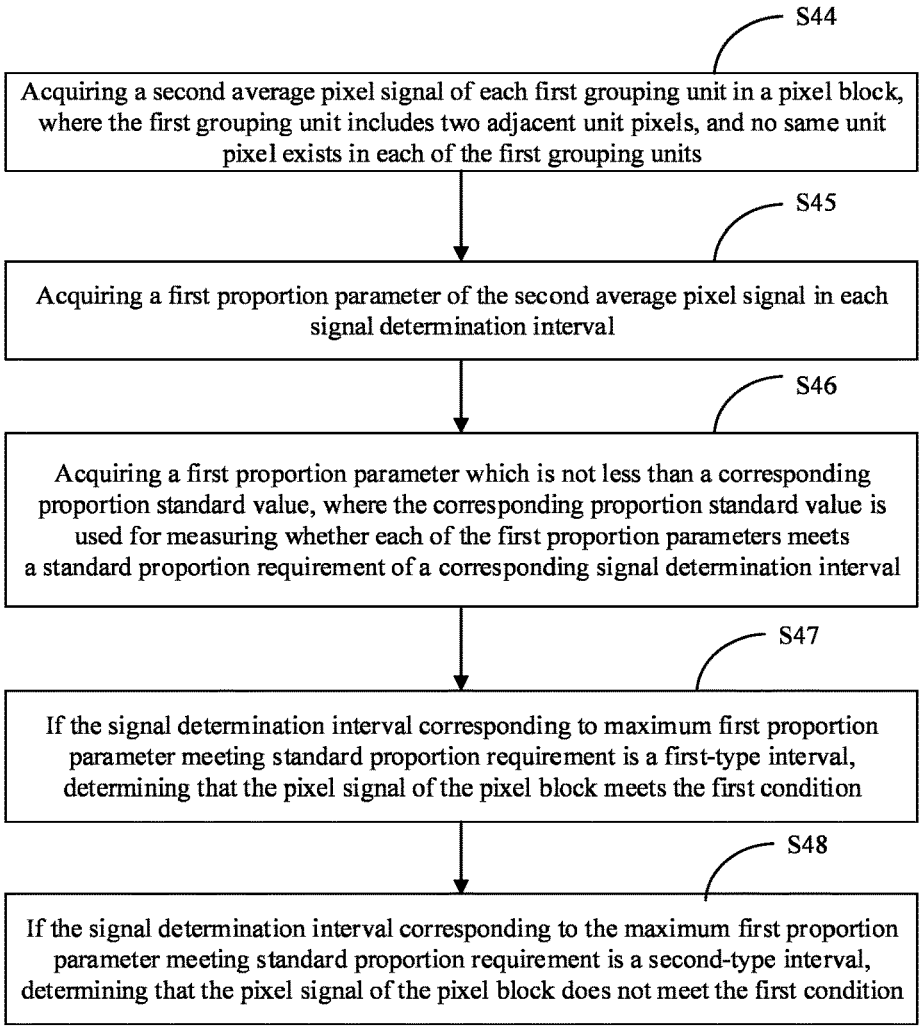
FIG. 9 is a flow schematic diagram of the step of determining whether the pixel signal of the pixel block meets a first condition according to another embodiment.
Figure 10:
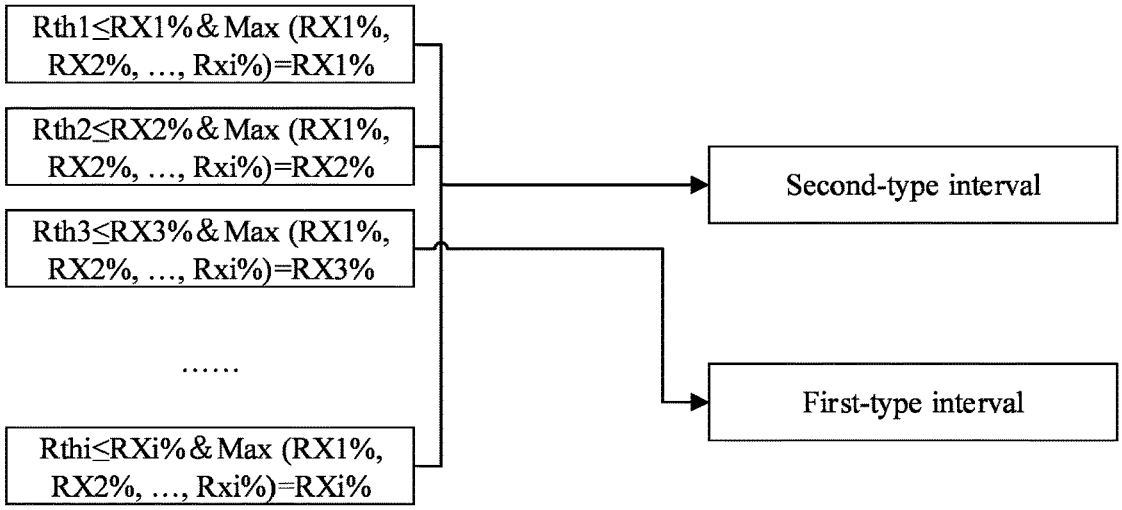
FIG. 10 is a schematic diagram illustrating the relationship between a signal determination interval, a first condition, and an interval type according to an embodiment.

In one or more embodiments, as shown in FIGS. 9 and 10, a signal determination interval includes a first-type interval and a second-type interval, and the step of determining whether a pixel signal of pixel block meets a first condition according to the pixel signal of each unit pixels and a signal determination interval includes:

S44: acquiring a second average pixel signal of each first grouping unit in the pixel block, where the first grouping unit includes two adjacent unit pixels, and no same unit pixel exists in each of the first grouping units;

S45: acquiring a first proportion parameter of the second average pixel signal in each signal determination interval;

S46: acquiring the first proportion parameter which is not less than a corresponding proportion standard value, where the corresponding proportion standard value is configured to measuring whether each of the first proportion parameters meets a standard proportion requirement of a corresponding signal determination interval S47: if the signal determination interval corresponding to maximum first proportion parameter meeting standard proportion requirement is a first-type interval, determining that the pixel signal of the pixel block meets the first condition; and S48: if the signal determination interval corresponding to the maximum first proportion parameter meeting standard proportion requirement is a second-type interval, determining that the pixel signal of the pixel block does not meet the first condition.

The definitions of first-type interval and second-type interval are the same as those of the above embodiments, and are not repeated herein. The proportion standard value is the lowest proportion value that can affect the display effect of the unit pixels falling in each signal determination interval when the pixel block is displayed.

Specifically, taking the red sub-pixels in the unit pixels as an example, if a certain pixel block includes n×m unit pixels, the average pixel signal of two adjacent red sub-pixels in k first grouping units in the pixel block, Rx-1, Rx-2, Rx-3, Rx-4, . . . , and Rx-k, is acquired and recorded as a second average pixel signal, and the proportion of k second average pixel signals of the pixel block in each of the signal determination intervals Rave-1, Rave-2, . . . , and Rave-i, which is a proportion parameter, is calculated. For example, the first proportional parameter of the k second average pixel signals Rx-1, Rx-2, Rx-3, Rx-4, . . . , Rx-k in the signal determination interval Rave-1 is Rx1%, the first proportional parameter in the signal determination interval Rave-2 is Rx2%, . . . , and the first proportional parameter in the signal determination interval Rave-i is RXi %.

When the adjacent red sub-pixel signals are in different signal determination intervals, the lightness corresponding to high gray-scale signals and the low gray-scale signals is different, when lightness difference of high and low gray-scale signals corresponding to adjacent red sub-pixel signals is large and the proportion of sub-pixels loaded with high and low gray-scale signals is not much different, it means that the pixel block presenting high and low gray-scale signals is are easy to be perceived by graininess and image pixel quality. Therefore, according to the average pixel signal of the adjacent red sub-pixels, it is possible to determining which signal determination interval the high and low gray-scale signals loaded to the pixel block are mainly concentrated.

As shown in FIG. 10, whether each first proportion parameter is greater than or equal to the corresponding proportion standard value (Rth1, Rth2, . . . , Rthi) is determined, those data that are too low and have too little impact on the pixel block when displayed as a whole are filtered out, then the largest first proportion parameter is acquired from the first proportion parameters meeting standard proportion requirement, the signal determination interval corresponding to the largest first proportion parameter is determined, and it indicates that the pixel voltage of the pixel block meets the first condition, that is, the pixel block has graininess during display if the signal determination interval is the first-type interval, and the pixel block has no graininess during display if the signal determination interval is the second-type interval. It should be noted that the determination process is applied to the red sub-pixel, the green sub-pixel, the blue sub-pixel, and/or the white sub-pixel in each unit pixel, and each determination process is directed to each type of same-color sub-pixel in each unit pixel.

Figure 11:
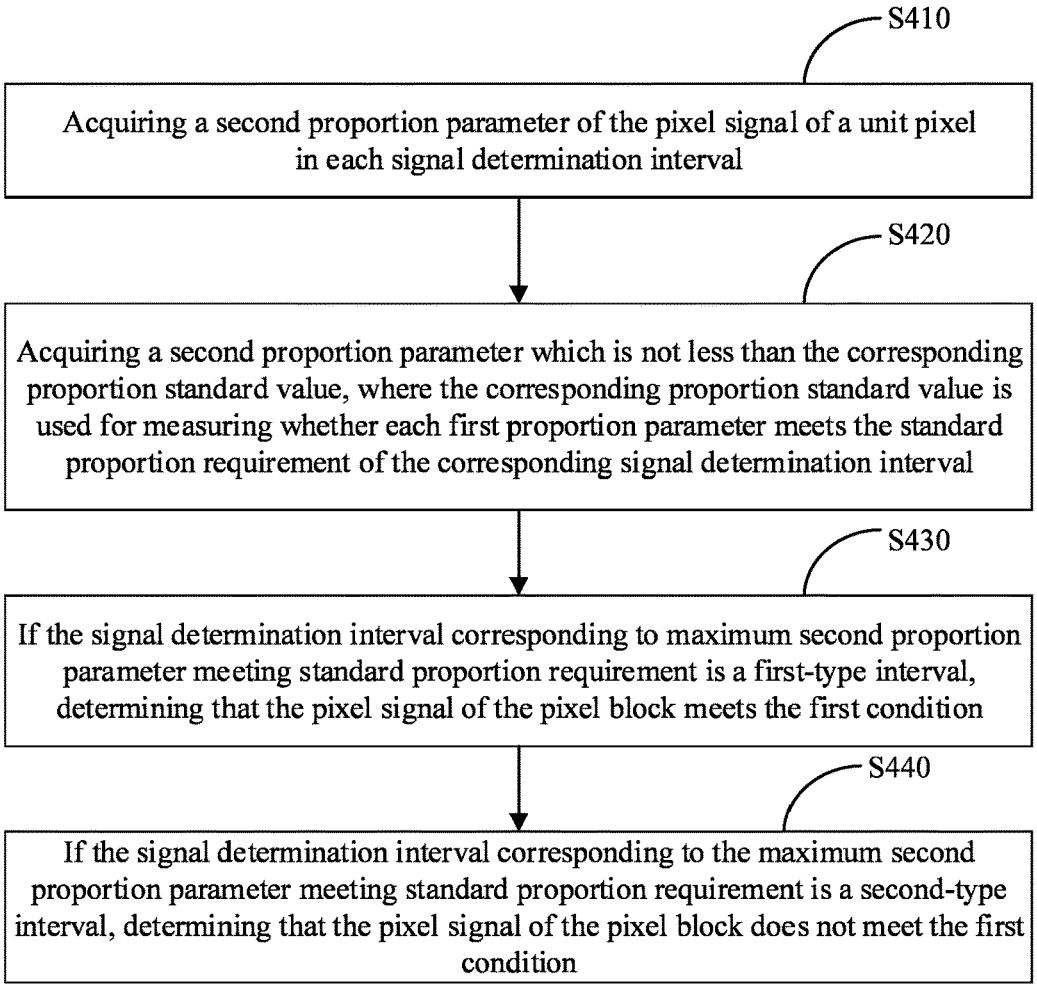
FIG. 11 is a flow schematic diagram of the step of determining whether the pixel signal of the pixel block meets a first condition according to yet another embodiment.

In one or more embodiments, as shown in FIGS. 10 and 11, a signal determination interval includes a first-type interval and a second-type interval, and the step of determining whether a pixel signal of pixel block meets a first condition according to the pixel signal of each unit pixels and a signal determination interval includes:

S410: acquiring a second proportion parameter of the pixel signal of the unit pixel in each signal determination interval;

S420: acquiring a second proportion parameter which is not less than the corresponding proportion standard value, where the corresponding proportion standard value is configured to measuring whether each first proportion parameter meets the standard proportion requirement of the corresponding signal determination interval;

S430: if the signal determination interval corresponding to maximum second proportion parameter meeting standard proportion requirement is a first-type interval, determining that the pixel signal of the pixel block meets the first condition; and S440: if the signal determination interval corresponding to the maximum second proportion parameter meeting standard proportion requirement is a second-type interval, determining that the pixel signal of the pixel block does not meet the first condition.

The definitions of the terms such as first-type interval, second-type interval, and proportion standard value are the same as those of the above embodiments, and are not repeated herein.

Specifically, after the pixel signal of each unit pixel is acquired, a second proportion parameter of the pixel signal value in each signal determination interval is acquired; then the second proportional parameter which does not meet the standard proportion requirement is eliminated, the maximum value is found in the second proportional parameters which meet the standard proportion requirement, the maximum second proportional parameter is acquired; whether the signal determination interval corresponding to the maximum second proportional parameter is a first-type interval or a second-type interval is determined; if the signal determination interval is the first-type interval, the pixel voltage of the corresponding pixel block is determined to meet the first condition, the pixel block has graininess during display, the gray-scale signal value loaded on each unit pixel needs to be adjusted, and if the pixel voltage is the second-type interval, the corresponding pixel block is determined to have no graininess during display.

Figures 12, 13:
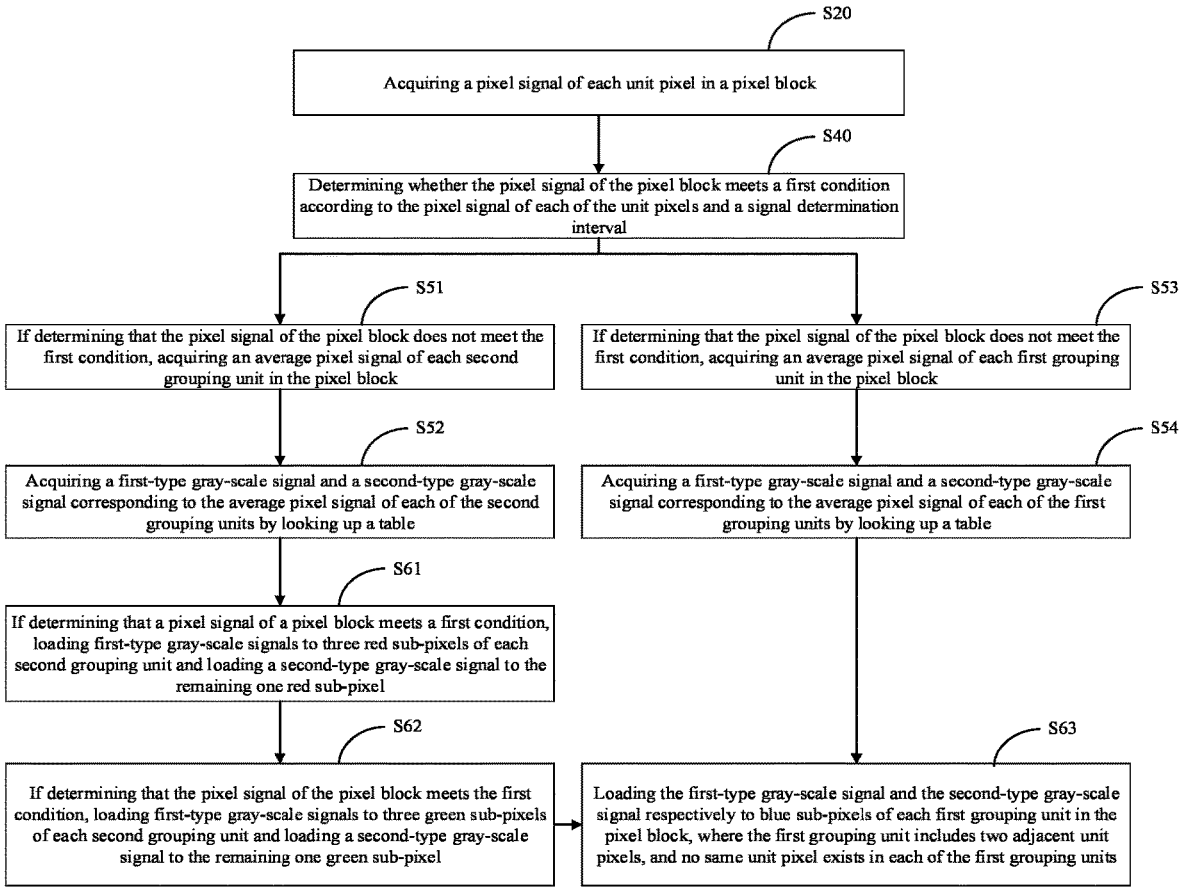
FIG. 12 is a flow schematic diagram of a pixel driving method according to still another embodiment.
FIG. 13 is a table showing the relationship between the first-type gray-scale signal and the second-type gray-scale signal corresponding to each average pixel signal according to still another embodiment.

In one or more embodiments, as shown in FIG. 12, the step of acquiring a first-type gray-scale signal and a second-type gray-scale signal includes:

S51: if determining that the pixel signal of the pixel block meets the first condition, acquiring an average pixel signal of each second grouping unit in the pixel block, where the second grouping unit includes four adjacent unit pixels, and no same unit pixel exists in each of the second grouping units; and S52: acquiring the first-type gray-scale signals and the second-type gray-scale signals corresponding to the average pixel signal of each of the second grouping units by looking up a table.

If determining that the corresponding pixel block has graininess during display, as shown in FIG. 12, a group of first-type and second-type gray-scale signals corresponding to the average pixel signals of 4 adjacent unit pixels in each second grouping unit of the pixel block can be acquired by looking up a table. If determining that a pixel voltage of the pixel block meets the first condition, that is, the pixel block has graininess during display, the 4 adjacent unit pixels can be driven by using 3 first-type gray-scale signals and 1 second-type gray-scale signal. The proportion of the sub-pixels with large lightness difference of high and low signal in the pixel block is reduced, so that the graininess does not exist during overall display.

In one or more embodiments, as shown in FIG. 12, the step of acquiring first-type gray-scale signals and second-type gray-scale signals further includes:

S53: if determining that the pixel signal of the pixel block does not meet the first condition, acquiring an average pixel signal of each first grouping unit in the pixel block, where the first grouping unit includes two adjacent unit pixels, and no same unit pixel exists in each of the first grouping units; and S54: acquiring the first-type gray-scale signal and the second-type gray-scale signal corresponding to the average pixel signal of each of the first grouping units by looking up a table.

If determining that the corresponding pixel block has no graininess during display, as shown in FIG. 12, a group of first-type and second-type gray-scale signals corresponding to the average pixel signal of 2 adjacent unit pixels in each first grouping unit of the pixel block can be acquired by looking up a table, providing data for subsequently loading of the gray-scale signal to each sub-pixel. Optionally, one first-type gray-scale signal and one second-type gray-scale signal may be configured to drive the two adjacent unit pixels, so that the pixel block has a good display effect at a wide viewing angle during display.

In one or more embodiments, as shown in FIG. 12, each unit pixel includes a red sub-pixel, and the step of loading first-type gray-scale signals to a part of unit pixels of the pixel block and loading second-type gray-scale signals to the remaining unit pixels of the pixel block based on a preset rule includes:

S61: if determining that the pixel signal of the pixel block meets the first condition, loading first-type gray-scale signals to three red sub-pixels of each second grouping unit and loading second-type gray-scale signal to the remaining one red sub-pixel.

Figures 14, 15:
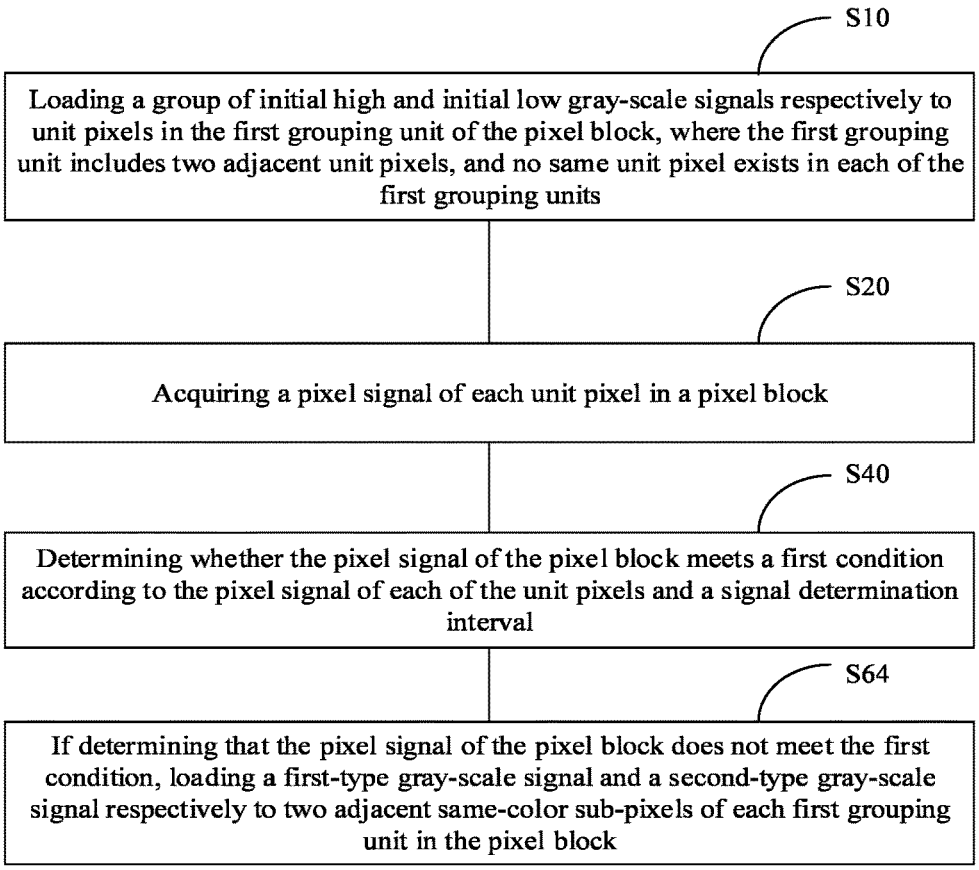
FIG. 14 is a table showing the relationship between the first-type gray-scale signal and the second-type gray-scale signal corresponding to each average pixel signal according to yet another embodiment.
FIG. 15 is a flow schematic diagram of a pixel driving method according to yet another embodiment.

If a certain pixel block has graininess during display, every four adjacent red sub-pixels are taken as a second sub-group unit, the first-type gray-scale signals are loaded to 3 red sub-pixels and the second-type gray-scale signal are loaded to 1 red sub-pixel according to the first-type gray-scale signals and the second-type gray-scale signals which are acquired in advance, and the proportion of the red sub-pixels with large lightness difference of high signals and low signals in the pixel block is reduced, thereby weakening the graininess during overall display and ensuring the display quality. Taking the red sub-pixel as an example, as shown in FIG. 6, the first-type gray-scale signal and the corresponding second-type gray-scale signal may be a high gray-scale signal RH and a low-gray-scale signal RL respectively, as shown in FIG. 13, a medium-low gray-scale signal RM and a high gray-scale signal RL respectively, as shown in FIG. 14, or a medium-low gray-scale signal RM and a low gray-scale signal RL.

In one or more embodiments, as shown in FIG. 12, each unit pixel includes a green sub-pixel, and the step of loading first-type gray-scale signals to a part of unit pixels of the pixel block and loading second-type gray-scale signals to the remaining unit pixels of the pixel block based on a preset rule includes:

S62: if determining that the pixel signal of the pixel block meets the first condition, loading first-type gray-scale signals to three green sub-pixels of each second grouping unit and loading second-type gray-scale signal to the remaining one green sub-pixel.

Similarly, for the green sub-pixels in the unit pixel, if the graininess is determined when the corresponding pixel block is displayed, the acquired first-type gray-scale signals can be loaded to three green sub-pixels in the second grouping unit, the second-type gray-scale signal can be loaded to the remaining one green sub-pixel, and the proportion of the green sub-pixels with large lightness difference of high and low gray-scale signals in the pixel block is reduced, so that the graininess when displayed as a whole is reduced, and the display quality is ensured.

In one or more embodiments, as shown in FIG. 12, unit pixel includes a blue sub-pixel, and the step of loading first-type gray-scale signals to a part of unit pixels of the pixel block and loading second-type gray-scale signals to the remaining unit pixels of the pixel block based on a preset rule includes:

S63: loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

Because human eyes have low sensitivity to the variation of blue color lightness and to the difference of lightness of blue sub-pixels, for the driving signals of the blue sub-pixels, a group of first-type and second-type gray-scale signals corresponding to the average pixel signal of every two adjacent blue sub-pixels can be configured to respectively replace the pixel signals B1 and B2 originally loaded to the two adjacent blue sub-pixels, the combination of the first-type gray-scale signal and the second-type gray-scale signal can achieve the effect of improving the color shift of viewing angle, and at the positive viewing angle, the average lightness of the group of first-type and second-type gray-scale signals can maintain the same as that of the original two independent sub-pixel signals B1 and B2.

In one or more embodiments, as shown in FIG. 15, the unit pixel includes a red sub-pixel, a green sub-pixel and a blue sub-pixel, and the pixel driving method further includes:

S64: If determining that the pixel signal of the pixel block does not meet the first condition, loading the first-type gray-scale signals and the second-type gray-scale signals respectively to two adjacent same-color sub-pixels of each first grouping unit in the pixel block.

For the pixel block without graininess during display, a group of first-type and second-type gray-scale signals corresponding to the average pixel signal of every two adjacent same-color sub-pixels can be configured to replace the pixel signals of the original adjacent same-color sub-pixels, so that the problem of the color shift of viewing angle can be effectively solved during display of the pixel block, and the display quality is improved. For example, for the red sub-pixel, if it is determined that the pixel block has graininess during display, a new driving voltage may be applied to each sub-pixel according to the first-type gray-scale signal and the second-type gray-scale signal corresponding to the average pixel signal in FIG. 6, FIG. 13, or FIG. 14.

In one or more embodiments, as shown in FIG. 15, before the step of acquiring a pixel signal of each unit pixel in the pixel block, the method further includes:

S10: loading a group of initial high and initial low gray-scale signals respectively to unit pixels in the first grouping unit of the pixel block, where the first grouping unit includes two adjacent unit pixels, and no same unit pixel exists in each of the first grouping units.

In order to ensure the large-viewing-angle display effect when the pixel block is displayed, a group of initial high and initial low gray-scale signals are respectively loaded to every two adjacent unit pixels during initialization. And then whether the pixel block has graininess during display is determined. If so, a group of first-type and second-type gray-scale signals corresponding to the average pixel signal of every four adjacent same-color sub-pixels are acquired, and the first-type gray-scale signals and the second-type gray-scale signals are loaded to each unit pixel according to a preset rule. If not, a group of first-type and second-type gray-scale signals corresponding to the average pixel signal of every two adjacent sub-pixels can be configured to replace the original initial high gray-scale signal and the initial low gray-scale signal. Or if not, the original initial high gray-scale signal and the initial low gray-scale signal can be remained unchanged; The initial high gray-scale signal and the initial low gray-scale signal can be acquired by looking up a table. It should be noted that the loading of the initial high gray-scale signal and the loading of the initial low gray-scale signal herein are both for the same-color sub-pixels in two adjacent unit pixels.

It should be understood that although the various steps of the flow diagrams in FIGS. 5 to 15 are shown in order as indicated by arrows, the steps are not necessarily performed in order as indicated by the arrows. The steps are not limited to being performed in the exact order illustrated and, unless explicitly stated herein, may be performed in other orders. Moreover, at least some of the steps in FIGS. 5 to 15 may include multiple sub-steps or multiple stages that are not necessarily performed at the same time, but may be performed at different times, and the sub-steps or stages are not necessarily performed sequentially, but may be performed in turn or alternately with other steps or at least some of the sub-steps or stages of other steps.

Figure 16:
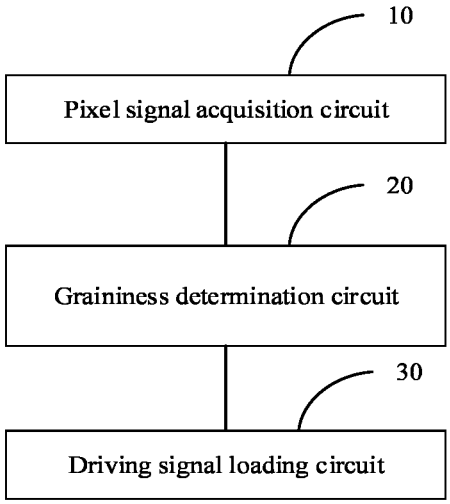
FIG. 16 is a structural schematic diagram of a pixel driving apparatus according to an embodiment.

A pixel driving apparatus, as shown in FIG. 16, includes:

a pixel signal acquisition circuit 10 configured to acquire a pixel signal of each unit pixel in a pixel block;

a graininess determination circuit 20 configured to determine whether the pixel signal of the pixel block meets a first condition according to the pixel signal of each unit pixel and a signal determination interval, where the first condition is configured to represent the graininess of the pixel block during display; and a driving signal loading circuit 30 configured to load first-type gray-scale signals to a part of unit pixels in the pixel block and load second-type gray-scale signals to the remaining unit pixels based on a preset rule if determining that the pixel signal of the pixel block meets the first condition, where the first-type gray-scale signals are not equal to the corresponding second-type gray-scale signals.

The definitions of the pixel block, the unit pixel, etc. are the same as those in the above embodiments, and are not repeated herein. Specifically, the pixel signal acquisition circuit 10 acquires a pixel signal of each unit pixel in the pixel block and sends the pixel signal to the graininess determination circuit 20; then the graininess determination circuit 20 determines whether the corresponding pixel block has graininess during display according to the acquired pixel signal of each unit pixel and a signal determination interval, and sends a determination result to the driving signal loading circuit 30; when the determination result meets a first condition, the driving signal loading circuit 30 loads first-type gray-scale signals to a part of unit pixels of the pixel block and loads second-type gray-scale signals to the remaining unit pixels according to a preset rule, where the first-type gray-scale signals are not equal to the corresponding second-type gray-scale signals. According to the pixel driving apparatus provided by the embodiments of the present application, the strength of the gray-scale signal loaded to each sub-pixel of the pixel block is correspondingly adjusted by determining whether the pixel block has graininess during display, thereby weakening the graininess during the display of the display panel formed by each pixel block and improving the display quality.

Moreover, the definition of the pixel driving method above can be referred to for the specific definition of the pixel driving apparatus, which thereby will not be described herein again. The modules in the pixel driving apparatus above can be wholly or partially implemented by software, hardware and a combination thereof. The above modules can be a hardware incorporated in or independent of a processor in the computer device, and can also be stored in a memory in the computer device in the form of a software, such that the processor can call and execute operations corresponding to the modules.

Figure 17:
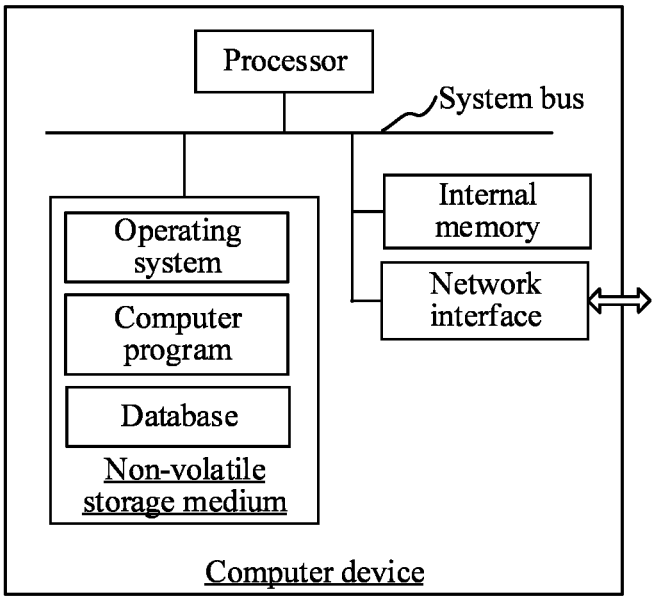
FIG. 17 is a diagram of an internal structure of a computer device according to an embodiment.

In one or more embodiments, a computer device is provided, which may be a server, and the internal structure diagram thereof may be as shown in FIG. 17. The computer device includes a processor, a memory, a network interface, and a database connected by a system bus. The processor of the computer device is configured to provide computing and controlling capabilities. The memory of the computer device includes a non-volatile storage medium and an internal memory. The non-volatile storage medium stores an operating system, a computer program, and a database. The internal memory provides an environment for the operation of the operating system and the computer program in the non-volatile storage medium. The database of the computer device is configured to store data such as a signal determination interval, a first-type gray-scale signal and a second-type gray-scale signal. The network interface of the computer device is configured to communicate with an external terminal through a network connection. The computer program is executed by the processor to implement a pixel driving method.

It will be understood by those skilled in the art that the structure shown in FIG. 17 is only a block diagram of part of structure associated with the present application, and is not intended to limit the computer device to which the present application may be applied, and that a specific computer device may include more or fewer components than shown in the FIG. 17, or may combine certain components, or have a different arrangement of components.

A computer device includes a memory having computer-readable instructions stored therein and one or more processors, where the computer-readable instructions, when executed by the one or more processors, cause the one or more processors to perform the steps of:

S20: acquiring a pixel signal of each unit pixel of each pixel block;

S40: determining whether the corresponding pixel block has graininess during display according to the pixel signal of each unit pixel and a signal determination interval; and S60: loading a first-type gray-scale signal or a second-type gray-scale signal to each unit pixel of the corresponding pixel block according to a preset rule according to the determination result, where the first-type gray-scale signal is larger than the corresponding second-type gray-scale signal.

When the computer device provided by the embodiments of the present application operates, the graininess in the pixel block during display can be determined according to the pixel signals of the sub-pixels of each pixel block, if the pixel block has graininess, the first-type gray-scale signal and the second-type gray-scale signal are loaded to each unit pixel of the pixel block according to the pre-stored preset rule, and the proportion of the sub-pixels with large difference of high gray-scale signals and low gray-scale signals in the pixel block is adjusted, so that the graininess of the pixel block during display is reduced, and the display quality is improved.

A computer-readable storage medium has a computer program stored thereon, and the computer program, when executed by a processor, implements the steps of:

S20: acquiring a pixel signal of each unit pixel of each pixel block;

S40: determining whether the corresponding pixel block has graininess during display according to the pixel signal of each unit pixel and a signal determination interval; and S60: loading a first-type gray-scale signal or a second-type gray-scale signal to each unit pixel of the corresponding pixel block according to a preset rule according to the determination result, where the first-type gray-scale signal is larger than the corresponding second-type gray-scale signal.

It will be understood by those skilled in the art that all or part of the processes of the method of the embodiments described above may be implemented by instructing relevant hardware through a computer program, which may be stored in a non-volatile computer-readable storage medium, and when executed, may include the processes of the method of the embodiments described above. Any reference to memory, storage, database or other medium used in the embodiments provided herein can include non-volatile and/or volatile memory. The non-volatile memory can include Read-Only Memory (ROM), Programmable ROM (PROM), Electrically Programmable ROM (EPROM), Electrically Erasable Programmable ROM (EEPROM), or flash memory. The volatile memory can include Random Access Memory (RAM) or external cache memory. By way of illustration rather than limitation, RAM is available in a variety of forms such as Static RAM (SRAM), Dynamic RAM (DRAM), Synchronous DRAM (SDRAM), Double Data Rate SDRAM (DDRSDRAM), Enhanced SDRAM (ESDRAM), Synchronous Link (Synchlink), Synchronous Link DRAM (SLDRAM), Rambus Direct RAM (RDRAM), Direct Rambus Dynamic RAM (DRDRAM), and Rambus Dynamic RAM (RDRAM).

The technical features of the embodiments described above can be combined arbitrarily. For the sake of brevity, all possible combinations of the technical features of the above embodiments are not described, and such combinations of the technical features shall be deemed to fall within the scope of the present disclosure as long as there is no contradiction.

The embodiments described above only describe several implementations of the present disclosure, and the description thereof is specific and detailed. However, those cannot be therefore construed as limiting the scope of the present application. It should be noted that, for those of ordinary skill in the art, several variations and modifications can be made without departing from the concept of the present disclosure, which also fall within the scope of the present disclosure. Therefore, the protection scope of the present application shall be defined by the appended claims.

What is claimed is:

1. A pixel driving method, comprising:

acquiring a pixel signal of each unit pixel in a pixel block;

determining whether the pixel signal of the pixel block meets a first condition according to the pixel signal of each of the unit pixels and a signal determination interval, wherein the first condition is configured to represent the graininess of the pixel block during display; and if determining that the pixel signal of the pixel block meets the first condition, loading first-type gray-scale signals to a part of unit pixels in the pixel block and loading second-type gray-scale signals to the remaining unit pixels based on a preset rule, wherein the first-type gray-scale signals are not equal to the corresponding second-type gray-scale signals.

2. The pixel driving method according to claim 1, wherein the signal determination interval comprises a first-type interval and a second-type interval, and the step of determining whether the pixel signal of the pixel block meets the first condition according to the pixel signal of each of the unit pixels and the signal determination interval comprises:

acquiring a second average pixel signal of each first grouping unit in the pixel block, wherein the first grouping unit comprises two adjacent unit pixels, and no same unit pixel exists in each of the first grouping units;

acquiring a first proportion parameter of the second average pixel signal in each of the signal determination intervals;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to maximum first proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

3. The pixel driving method according to claim 1, wherein the signal determination interval comprises a first-type interval and a second-type interval, and the step of determining whether the pixel signal of the pixel block meets the first condition according to the pixel signal of each of the unit pixels and the signal determination interval comprises:

acquiring a second proportion parameter of the pixel signal of the unit pixel in each of the signal determination intervals;

acquiring the second proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to maximum second proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

4. The pixel driving method according to claim 1, wherein the step of acquiring the first-type gray-scale signal and the second-type gray-scale signal comprises:

if determining that the pixel signal of the pixel block meets the first condition, acquiring an average pixel signal of each second grouping units in the pixel block, wherein the second grouping units comprise four adjacent unit pixels, and no same unit pixel exists in each of the second grouping units; and acquiring the first-type gray-scale signal and the second-type gray-scale signal corresponding to the average pixel signal of each of the second grouping units by looking up a table.

5. The pixel driving method according to claim 3, wherein the step of acquiring the first-type gray-scale signal and the second-type gray-scale signal comprises:

if determining that the pixel signal of the pixel block meets the first condition, acquiring an average pixel signal of each second grouping units in the pixel block, wherein the second grouping units comprise four adjacent unit pixels, and no same unit pixel exists in each of the second grouping units; and acquiring the first-type gray-scale signal and the second-type gray-scale signal corresponding to the average pixel signal of each of the second grouping units by looking up a table.

6. The pixel driving method according to claim 1, wherein the step of acquiring the first-type gray-scale signal and the second-type gray-scale signal comprises:

if determining that the pixel signal of the pixel block does not meet the first condition, acquiring an average pixel signal of each first grouping unit in the pixel block, wherein the first grouping unit comprises two adjacent unit pixels, and no same unit pixel exists in each of the first grouping units; and acquiring the first-type gray-scale signal and the second-type gray-scale signal corresponding to the average pixel signal of each of the first grouping units by looking up a table.

7. The pixel driving method according to claim 4, wherein the unit pixel comprises a blue sub-pixel, and the step of loading first-type gray-scale signals to a part of unit pixels of the pixel block and loading second-type gray-scale signals to the remaining unit pixels of the pixel block based on a preset rule further comprises:

if determining that the pixel signal of the pixel block meets the first condition, loading first-type gray-scale signals to three red sub-pixels of each of the second grouping units and loading second-type gray-scale signal to the remaining one red sub-pixel.

8. The pixel driving method according to claim 7, wherein the unit pixel comprises a blue sub-pixel, and the step of loading first-type gray-scale signals to a part of unit pixels of the pixel block and loading second-type gray-scale signals to the remaining unit pixels of the pixel block based on a preset rule further comprises:

if determining that the pixel signal of the pixel block meets the first condition, loading first-type gray-scale signals to three green sub-pixels of each second grouping unit and loading second-type gray-scale signal to the remaining one green sub-pixel.

9. The pixel driving method according to claim 8, wherein the unit pixel comprises a green sub-pixel, and the step of loading first-type gray-scale signals to a part of unit pixels of the pixel block and loading second-type gray-scale signals to the remaining unit pixels of the pixel block based on a preset rule further comprises:

loading the first-type gray-scale signal and the second-type gray-scale signal respectively to blue sub-pixels of each of the first grouping units in the pixel block, wherein the first grouping unit comprises two adjacent unit pixels, and no same unit pixel exists in each of the first grouping units.

10. The pixel driving method according to claim 6, wherein the unit pixel comprises a red sub-pixel, a green sub-pixel and a blue sub-pixel, and the pixel driving method further comprises the steps of:

if determining that the pixel signal of the pixel block does not meet the first condition, loading the first-type gray-scale signals and the second-type gray-scale signals respectively to two adjacent same-color sub-pixels of each of the first grouping units in the pixel block.

11. The pixel driving method according to claim 1, wherein before the step of acquiring a pixel signal of each unit pixel in a pixel block, further comprising:

loading a group of initial high and initial low gray-scale signals respectively to unit pixels in the first grouping unit of the pixel block, wherein the first grouping unit comprises two adjacent unit pixels, and no same unit pixel exists in each of the first grouping units.

12. A pixel driving apparatus, comprising:

a pixel signal acquisition circuit configured to acquire a pixel signal of each unit pixel in a pixel block;

a graininess determination circuit configured to determine whether the pixel signal of the pixel block meets a first condition according to the pixel signal of each unit pixel and a signal determination interval, wherein the first condition is configured to represent the graininess of the pixel block during display; and a driving signal loading circuit configured to load first-type gray-scale signals to a part of unit pixels of the pixel block and loading second-type gray-scale signals to the remaining unit pixels of the pixel block based on a preset rule when determining that the pixel signal of the pixel block meets the first condition, wherein the first-type gray-scale signals are not equal to the corresponding second-type gray-scale signals.

13. A computer device, comprising a memory having computer-readable instructions stored therein and one or more processors, wherein the computer-readable instructions, when executed by the one or more processors, cause the one or more processors to perform the steps of:

acquiring a pixel signal of each unit pixel in a pixel block;

determining whether the pixel signal of the pixel block meets a first condition according to the pixel signal of each of the unit pixels and a signal determination interval, wherein the first condition is configured to represent the graininess of the pixel block during display; and if determining that the pixel signal of the pixel block meets the first condition, loading first-type gray-scale signals to a part of unit pixels in the pixel block and loading second-type gray-scale signals to the remaining unit pixels based on a preset rule, wherein the first-type gray-scale signals are not equal to the corresponding second-type gray-scale signals.

14. The computer device according to claim 13, wherein the signal determination interval comprises a first-type interval and a second-type interval, and the step of determining whether the pixel signal of the pixel block meets the first condition according to the pixel signal of each of the unit pixels and the signal determination interval comprises:

acquiring a second average pixel signal of each first grouping unit in the pixel block, wherein the first grouping unit comprises two adjacent unit pixels, and no same unit pixel exists in each of the first grouping units;

acquiring a first proportion parameter of the second average pixel signal in each of the signal determination intervals;

acquiring the first proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to maximum first proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

15. The computer device of claim 1, wherein the processor, when executing the computer readable instructions, further performs the steps of:

acquiring a second proportion parameter of the pixel signal of the unit pixel in each of the signal determination intervals;

acquiring the second proportion parameter which is not less than a corresponding proportion standard value, wherein the corresponding proportion standard value is configured to measure whether each of the first proportion parameters meets a standard proportion requirement of a corresponding signal determination interval;

if the signal determination interval corresponding to maximum second proportion parameter meeting standard proportion requirement is a first-type interval, determining that the pixel signal of the pixel block meets the first condition; and if the signal determination interval corresponding to the maximum first proportion parameter meeting standard proportion requirement is a second-type interval, determining that the pixel signal of the pixel block does not meet the first condition.

16. The computer device of claim 13, wherein the processor, when executing the computer readable instructions, further performs the steps of:

if determining that the pixel signal of the pixel block meets the first condition, acquiring an average pixel signal of each second grouping units in the pixel block, wherein the second grouping units comprise four adjacent unit pixels, and no same unit pixel exists in each of the second grouping units; and acquiring the first-type gray-scale signal and the second-type gray-scale signal corresponding to the average pixel signal of each of the second grouping units by looking up a table.

17. The computer device of claim 15, wherein the processor, when executing the computer readable instructions, further performs the steps of:

if determining that the pixel signal of the pixel block meets the first condition, acquiring an average pixel signal of each second grouping units in the pixel block, wherein the second grouping units comprise four adjacent unit pixels, and no same unit pixel exists in each of the second grouping units; and acquiring the first-type gray-scale signal and the second-type gray-scale signal corresponding to the average pixel signal of each of the second grouping units by looking up a table.

18. The computer device of claim 1, wherein the processor, when executing the computer readable instructions, further performs the steps of:

if determining that the pixel signal of the pixel block does not meet the first condition, acquiring an average pixel signal of each first grouping unit in the pixel block, wherein the first grouping unit comprises two adjacent unit pixels, and no same unit pixel exists in each of the first grouping units; and acquiring the first-type gray-scale signal and the second-type gray-scale signal corresponding to the average pixel signal of each of the first grouping units by looking up a table.

19. The computer device of claim 16, wherein the processor, when executing the computer readable instructions, further performs the steps of:

if determining that the pixel signal of the pixel block meets the first condition, loading first-type gray-scale signals to three red sub-pixels of each of the second grouping units and loading second-type gray-scale signal to the remaining one red sub-pixel.

20. The computer device of claim 19, wherein the processor, when executing the computer readable instructions, further performs the steps of:

if determining that the pixel signal of the pixel block meets the first condition, loading first-type gray-scale signals to three green sub-pixels of each second grouping unit and loading second-type gray-scale signal to the remaining one green sub-pixel.

* * * * *